United States Patent [19]

Logsdon

[11] Patent Number: 4,925,045

[45] Date of Patent: May 15, 1990

[54] TUB BOXES

[75] Inventor: Duane D. Logsdon, Fullerton, Calif.

[73] Assignee: Logsdon Foundation, Staton, Calif.

[21] Appl. No.: 430,721

[22] Filed: Nov. 1, 1989

[51] Int. Cl.[5] ..... B65D 6/00

[52] U.S. Cl. ..... 220/4 E; 220/3.94

[58] Field of Search ..... 220/4 E, 3.94, 4 B

[56] References Cited

U.S. PATENT DOCUMENTS

| | | | |
|---|---|---|---|
| 4,216,763 | 8/1980 | Miklas | 220/4 E |
| 4,217,984 | 8/1980 | Magnuson | 220/4 E |
| 4,273,249 | 6/1981 | Florian | 220/4 E |
| 4,360,118 | 11/1982 | Stern | 220/4 E |
| 4,512,471 | 4/1985 | Kaster et al. | 220/4 E |
| 4,664,254 | 5/1987 | Sitwell et al. | 220/4 E |

*Primary Examiner*—Joseph Man-Fu Moy

*Attorney, Agent, or Firm*—Price, Gess & Ubell

[57] ABSTRACT

A desirable tub box can be constructed using identical, hollow housing and closure sections having perpherial or edge flanges carrying cooperating male and female structures which secure the sections together in a face to face relationship. Knockout opening areas are provided in the peripheries of the sections so as to provide an opening to accommodate a pipe.

6 Claims, 2 Drawing Sheets

TUB BOXES

BACKGROUND OF THE INVENTION

The Invention set forth in this specification pertains to new and improved tub boxes.

More specifically it pertains to tub boxes which are related to tub boxes as are set froth in the prior Duane D. Logsdon U.S. Pat. Nos. 3,593,344 issued July 20, 1971 entitled "Tub Box Structure" and 4,742,588 issued May 10, 1988 entitled "Tub box." Both of these prior patents disclose highly utilitarian tub boxes of tub box structures which utilize a polymer or plastic lower housing section or means having a bottom and a continuous perpherial wall leading to an open top and a polymer or plastic closure or closure section or means fitting with respect to the peripherial wall so as to close off the open top in order to define an internal cavity.

In such prior structures flanges are used on the housing and closure sections to support one on the other and in order to effectively close of the interior cavity from the exterior of the assembled tub box. These flanges are formed so that effectiveness of the seal between them is primarily dependent upon how well they fit against one another. While in many cases this is satisfactory there are cases where warpage of the plastic has warped for one reason or another or where a contaminant such as some dirt has gotten between the flanges. In such cases the internal cavities in these prior structures are not considered to have been adequately been closed off, This is believed to have been particularly the case since these structures have not used effective means to hold or secure the flanges together.

Such prior structures are considered to be somewhat less that fully or completely desirable for another, additional reason. This concerns the problem of locating them so that a drain pipe extends into their interiors. Because of the time and the complications involved in cutting a hole in a wall for a pipe to enter through a bottom or perpherial wall of a housing section of a tub box the more recent of the two patents noted in the preceding recognized the importance of forming the housing section of a tub box so as to include knockout pipe openings which could be opened up in a wall by a simple physical blow or the easy use of a cutting tool.

Unfortunately neither of the indicated patents recognized that in many cases it would be difficult or undesirable to fit a tub box housing section over the end of a pipe or in fitting a pipe through such a hole in assembling the tub box and the pipe together so that the tub box could be used. It is considered that his had the effect of limiting the use of prior tub boxes as noted.

BRIEF SUMMARY OF THE INVENTION

As a result of the factors indicated in the preceding it is considered that there is a need for new and improved tub boxes which over come limitations of prior art tub boxes, the invention is intended to provide improved tub boxes meeting this need.

From this it is believed that it will be apparent that the invention is intended to provide improved tub boxes which are constructed so as to provide an adequate barrier or seal between the housing and closing sections of the tub box. The invention is also intended to provide tub boxes which are constructed in such a manner that such sections can be easily, conveniently and adequately secured together and in such a manner that they can be easily disassembled if this should for any reason be necessary. In addition the invention is intended to provide tub boxes which are constructed in such a manner that they can be easily and conveniently adapted to be used with one or more pipes and which can be installed on a pipe without being moved over an end of the pipe or without a pipe being slid through a hole.

It is considered important to note that the invention is intended to provide tub boxes having all of the advantages indicated in the preceding which are comparatively inexpensive to produce, which may be easily stored with the parts for a series of these boxes nested together and which are comparatively easy to use. All of these factors are considered important in connection with the acceptably of tub boxes of the invention.

A desirable tub box in accordance with the invention can be achieved by providing such a box including (1) a hollow body housing having a bottom wall means, continuous perpherial wall means attached to the perimeter of said bottom wall means and extending upwardly therefrom, an open top, an edge flange attached to said perpherial wall means completely around said open top and extending outwardly from said open top and knockout opening means in said wall means for use in creating an opening in said wall means leading into the interior of said housing and (2) closure means covering said open top, said closure means including an edge flange fitting against said flange on said housing, in which the improvement comprises:

said housing and said closure means being identical to one another, said housing and said closure means each including a plurality of said knock out means located in said perpherial wall means adjacent to said open top and extending thorough the edge flanges of said housing and said closure means, each of said knockout means being of a "U" shaped configuration having a curved bottom connecting parallel sides, said sides being shaped so as to extend across said edge flanges and terminate at the peripheries of said said edge flanges, said housing means and said closure means each including both male and female holding means for securing said housing means and said closure means with their edge flanges resting against one another in an assembled configuration so that the interiors of said housing means and said closure means are joined through the open tops of said housing means and said closure means, said holding means securing said housing means and said closure means in said assembled configuration, said male and female holding means being capable of being pushed together so as to engage one another in securing said housing means and said closure means together in said assembled configuration and being capable of being pried apart in separating said housing means and said closure means, and said edge flanges on said housing means and said closure means including sealing means which fit against one another when said housing means and said closure means are in said assembled configuration so as to seal off the interiors of said housing means and said closure means except where one of said knockout means has been removed.

BRIEF DESCRIPTION OF THE DRAWING

Unfortunately the nature of tub boxes in accordance with the invention make it difficult to adequately indicate or summarize the invention using fewer words than are used in the preceding. Because of the nature of the invention it is best more fully described with reference to the accompanying drawing in which.

Figure 1:
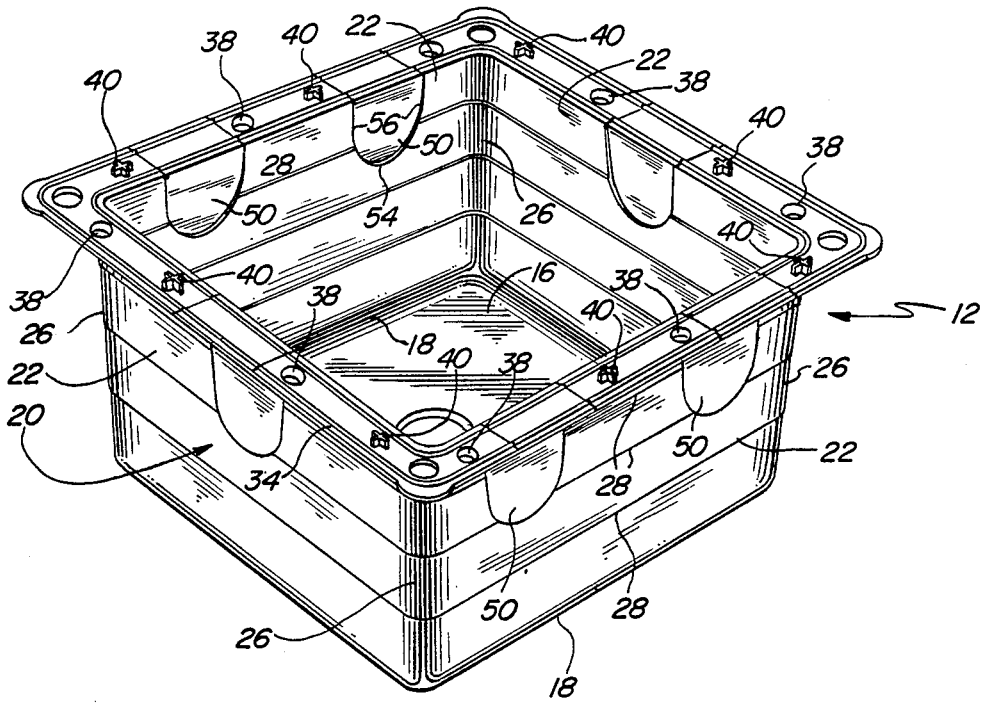
FIG. 1 is an isometric view of a presently preferred body housing section for use with the invention, an isometric view of a closure section in accordance with the invention being identical with this view.

The precise tub box illustrated in the drawing is constructed so as to utilize the principles or concepts of the invention set forth and defined in the appended claims. Those skilled in the field of the invention will realize that these concepts can be used in or embodied in tub boxes which are somewhat differently appearing and somewhat differently constructed than the tub box illustrated. For this reason the invention is to be considered as being limited solely by the appended claims.

DETAILED DESCRIPTION OF THE PREFERRED EMBODIMENT

In the drawing there is shown a tub box 10 in accordance with the invention which is constructed of two identical sections 12 and 14. Because of the relationship of the box 10 to prior related tub boxes the section 12 can be designated as a "body housing" or as a "body housing section" or as a "housing section" or as a "housing means". For the same reason the section 14 can be designated as a "closure" or a "closure section" or as a "closure means". Both of these sections are preferably formed of a plastic or polymer materials such as have been previously used in forming the parts of tub boxes by conventional injection molding techniques.

Each of the sections 12 and 14 has a bottom or central substantially flat wall 16 having a perpherial edge 18 connected to a continuous or endless perpherial wall structure 20 which preferably includes 4 separate flat, perpherial walls 22. These walls 22 are have side edges 24 connected by small curved end walls 26. If desired so as facilitate the removal of the sections 12 and 14 from a mold as they are being manufactured these walls 22 and 26 are preferably slightly tapered as shown and are preferably provided with parallel stiffening offsets 28. These walls 22 are preferably located in a common rectangular pattern in order to facilitate access to a pipe extending into a fully assembled tub box 10.

The walls 22 and 26 in each of the sections 12 and 14 has edges 30 remote from the wall 16 which carry an endless edge flange 32. These edge flanges 32 are provided with two spaced, perpherial, endless sealing beads 34 shaped more or less like a half of a common O-ring. The beads 34 face generally away from the remainders of the sections 12 and 14 and are located so that when the tub box 10 is assembled the beads 34 on the sections 12 and 14 will contact one another so as to tend to form two separate barricades or seals (not separately numbered) which will tend to preclude extraneous mater from entering an interior cavity 36 defined by the sections 12 and 14 when the tub box has been assembled. Normally the edge flanges 32 will be sufficiently flexible so as to accommodate minor dimensional differences or minor amounts of extraneous matter (not shown) on either of the flanges 32 from seriously interfering with the barricade or sealing action obtained.

Figure 2:
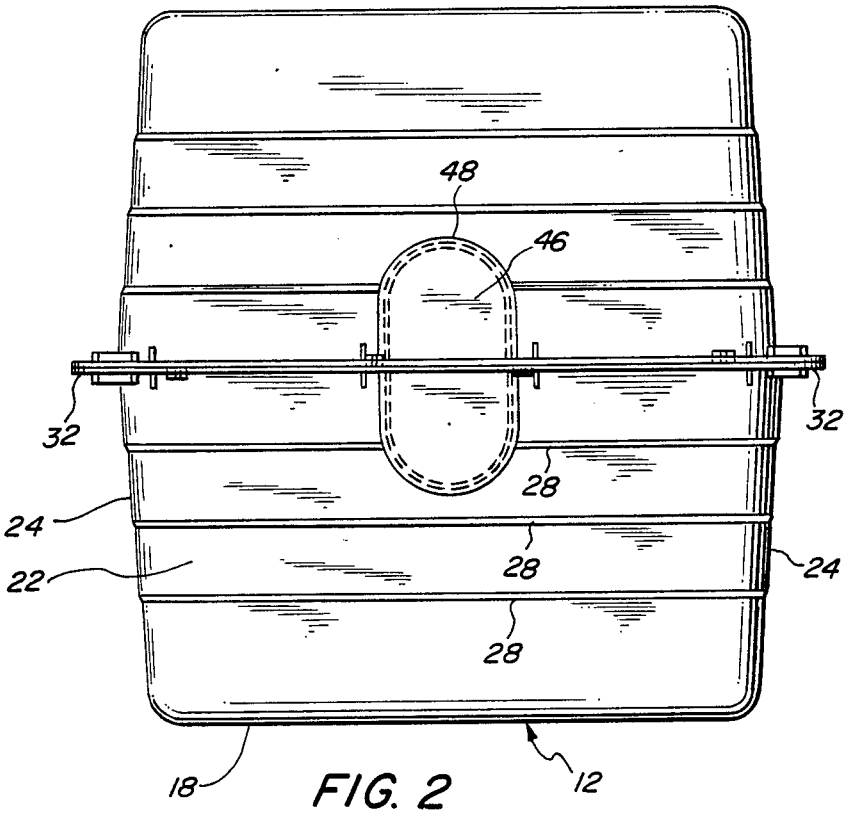
FIG. 2 is a small side elevational view of a tub box which has been assembled from two sections corresponding to the section shown in FIG. 1.
Figure 3:
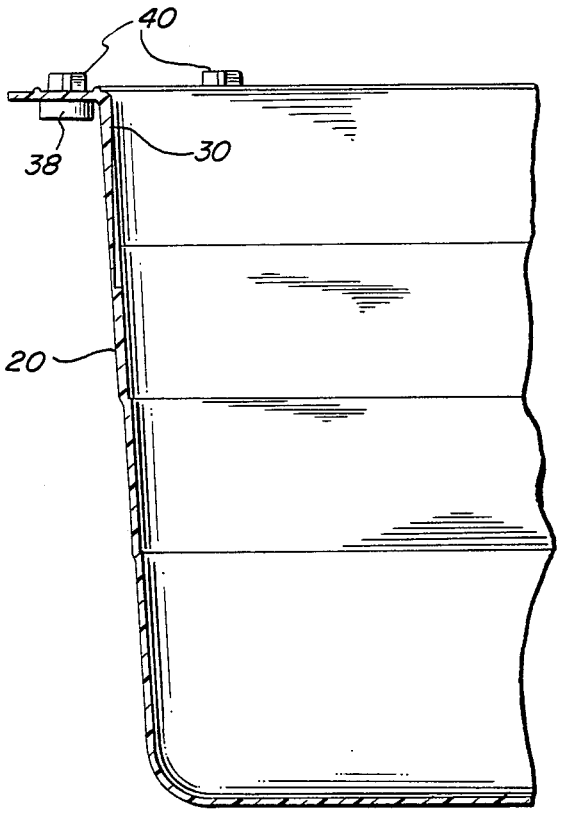
FIG. 3 is a partial cross-sectional view at an enlarged scale taken at line 3—3 of FIG. 2 showing a knockout opening area prior to the opening being created.
Figure 4:
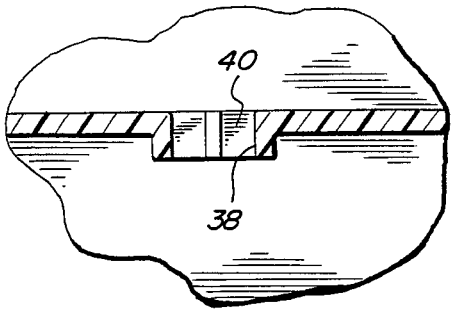
FIG. 4 is a partial cross-sectional view at an enlarged scale taken at line 4—4 of FIG. 2 showing cooperating male and female holding means as used in securing the sections together.

A series of coacting female holding members 38 and male holding members 40 are spaced from one another on the flanges 32 in such a manner as to permit the sections 12 and 14 to be assembled as shown in FIG. 2 even though they are of an identical construction. Since the manner in which these holding members 38 and 40 are arranged is easily apparent from the drawing it will not be described in detail in this specification. In order to obtain an adequate holding action it is presently considered at at least one holding member 38 and one holding member 40 should be located adjacent to each perpherial wall 22. With a normally sized tub box 10 the use of other, additional holding members is considered to be an economic waste.

In the tub box 10 shown two parallel walls 22 in each of the sections 12 and 14 are longer than the other walls 22 in such sections. When this is the case and when the tub 10 is of what may be considered as a normal or conventional size for a tub box it is considered desirable to have two pairs of holding members 38 and and 40 on the longer walls 22 and a single pair of these holding members 38 and 40 on the shorter walls 22 in order to achieve an effective holding action without using more holding members 38 and 40 than reasonably necessary.

Although a number of different types of holding members 38 can be used within the board concepts of the invention it is considered that the female holding members 38 should preferably be small cylindrical studs 42 having hollow, cylindrical interiors 44 and that the male holding members 40 should be elongated studs having a cruciform cross-sectional configuration of such a dimension as to be capable of being press fitted within the interiors of the studs 42. Further, preferably the interiors 44 have open ends 45. These shapes or configurations are preferred because they are easily manufactured and normally operate in a satisfactory manner, even when dirt or other contamination is present. Because of the open ends 45 there is substantially no danger of contamination precluding the holding members 40 from being forced into the interiors 44 to the maximum possible extent.

Preferably the tolerances should be such that it is normally extremely difficult to press fit the male members 40 in place by hand, but simple to accomplish this with a common tool such as pliers. With the type of connection obtained it is simple to jamb a different tool such as a screwdriver between the edge flanges 32 on sections 12 and 14 which have been secured together in order to separate them if this should for any reason be necessary or desirable. As an alternative to this such a tool can be inserted through an end 45 so as to force a holding member 40 out of a stud 42.

In the sections 12 and 14 the walls 16 are provided with a conventional centrally located knockout opening area 46 defined by two concentric rings 48 of reduced material thickness. These two rings 48 are used so that an opening of either or two desired diameters as may be required in a specific installation can be easily created in conventional manner using a cutting tool or a tool capable of delivering a blow.

In these sections 12 and 14 the walls 22 are also provided with other different knockout opening areas 50 as shown. Each of the areas 50 is of a generally "U" shaped configuration and includes a line 52 of reduced material thickness capable of being easily severed or broken having a curved, semi-circular bottom 54 and connecting parallel sides 56. These sides 56 of the lines 52 extend not only along the walls 22 but in addition extend across the adjacent edge flanges 32—including the beads 34 located on them. As a result of this construction any specific area 50 can be removed in the conventional manner in which a knockout area is removed so as to create a more or less "U" shaped notch or opening (not shown) from such area 50.

As a result of the fact that any opening created from an area 50 is not completely sounded by the material in a section 12 or 14 a pipe (not shown) can be located so as to extend through such an opening (not shown) as the tub box 10 is being assembled. This avoids the prior need to either insert a pipe (not shown) through an conventional opening or to move a part of a tub box (not shown) over an end of a pipe (not shown) to a desired position.

Although these areas 50 can all be of the same dimension or can all be formed using two of the lines 52 located parallel to one another so as to accommodate differently sized pipes when two of the walls 22 are shorter than the other walls 22 on a section 12 or 14 it is preferred to make the areas on the shorter of the walls 22 of such a dimension as to accommodate pipes of different sizes and to provide areas 50 corresponding to pipes of different dimensions in the longer walls 22.

I claim:

1. A tub box including (1) a hollow body housing means having a bottom wall means, continuous perpherial wall means attached to the perimeter of said bottom wall means and extending upwardly therefrom, an open top, an edge flange attached to said perpherial wall means completely around said open top and extending outwardly from said open top and knock-out opening means in said wall means for use in creating an opening in said wall means leading into the interior of said housing and (2) closure means covering said open top, said closure means including an edge flange fitting against said flange on said housing, in which the improvement comprises:

said housing and said closure means being identical to one another, said housing and said closure means each including a plurality of said knockout means located in said perpherial wall means adjacent to said open top and extending thorough the edge flanges of said housing and said closure means, each of said knockout means being of a "U" shaped configuration having a curved bottom connecting parallel sides, said sides being shaped so as to extend across said edge flanges and terminate at the peripheries of said said edge flanges, said housing means and said closure means each including both male and female holding means for securing said housing means and said closure means with their edge flanges resting against one another in an assembled configuration so that the interiors of said housing means and said closure means are joined through the open tops of said housing means and said closure means, said holding means securing said housing means and said closure means in said assembled configuration, said male and female holding means being capable of being pushed together so as to engage one another in securing said housing means and said closure means together in said assembled configuration and being capable of being pried apart in separating said housing means and said closure means, and said edge flanges on said housing means and said closure means including sealing means which fit against one another when said housing means and said closure means are in said assembled configuration so as to seal off the interiors of said housing means and said closure means except where one of said knockout means has been removed.

2. A tub box as claimed in claim 1 wherein:

said sealing means on each of said edge flanges comprises two endless projecting sealing beads which are spaced from one another and located on said edge flanges so that the sealing beads on said housing means will abut the sealing beads on said closure means when said housing means and said closure means are in said said assembled configuration.

3. A tub box as claimed in claim 2 wherein:

said holding means on said housing means and said closure means are located between said sealing beads on said edge flanges.

4. A tub box as claimed in claim 1 wherein:

each of said female holding means include hollow, internally cylindrical stud and each of said male holding means includes a stud capable of being press fitted into such a hollow stud.

5. A tub box as claimed in claim 4 wherein:

said studs of said male holding means are of a cruciform cross-sectional configuration.

6. A tub box as claimed in claim 1 wherein:

said sealing means on each of said edge flanges comprises two endless projecting sealing beads which are spaced from one another and located on said edge flanges so that the sealing beads on said housing means will abut the sealing beads on said closure means when said housing means and said closure means are in said said assembled configuration, said holding means on said housing means and said closure means are located between said sealing beads on said edge flanges.

each of said female holding means include hollow, internally cylindrical stud and each of said male holding means includes a stud capable of being press fitted into such a hollow studs, said studs of said male holding means are of a cruciform cross-sectional configuration.

* * * * *